US005634286A

United States Patent [19]

Johnson

[11] Patent Number: 5,634,286

[45] Date of Patent: Jun. 3, 1997

[54] DISPLAY SIGN

[76] Inventor: Robert D. Johnson, #100, 4723 1 St. Street, SW, Calgary, Alberta, Canada, T2G 4Y8

[21] Appl. No.: 553,869

[22] Filed: Nov. 6, 1995

[51] Int. Cl.[6] ..... G09F 13/04

[52] U.S. Cl. ..... 40/564; 40/546; 40/549; 362/396

[58] Field of Search ..... 40/545, 546, 549, 40/564, 575, 606, 740, 785; 362/396

[56] References Cited

U.S. PATENT DOCUMENTS

| | | | |
|---|---|---|---|
| 1,669,782 | 5/1928 | Risser | 40/606 X |
| 1,786,033 | 12/1930 | Smith | 40/564 |
| 2,885,538 | 5/1959 | Mahon et al. | 40/545 X |
| 3,771,245 | 11/1973 | Mabrey et al. | 40/564 X |
| 3,835,613 | 9/1974 | Davies, Jr. | 40/549 X |
| 4,014,119 | 3/1977 | Teufel | 40/740 |
| 4,070,779 | 1/1978 | Gilmour | 40/575 |
| 4,587,754 | 5/1986 | Ossner | 40/564 |
| 4,674,211 | 6/1987 | Pratt | 40/564 |
| 4,851,971 | 7/1989 | MacLagan | 40/564 X |
| 4,901,461 | 2/1990 | Edwards et al. | 40/575 |
| 5,008,787 | 4/1991 | Sklar et al. | 362/221 |
| 5,142,461 | 8/1992 | Nugent | 362/396 X |
| 5,303,488 | 4/1994 | Todd et al. | 40/785 |
| 5,384,978 | 1/1995 | Peters | 40/785 |
| 5,426,879 | 6/1995 | Hecker | 40/427 |

FOREIGN PATENT DOCUMENTS

| | | | |
|---|---|---|---|
| 740743 | 6/1952 | Germany | 40/546 |

*Primary Examiner*—Kenneth J. Dorner
*Assistant Examiner*—Andrea Chop
*Attorney, Agent, or Firm*—Michael I. Kroll

[57] ABSTRACT

An improved display sign (10) comprising an extruded frame (12). A rear panel (14) is provided. An element (16) is for mounting the perimeter of the rear panel (14) in a removable manner to a back portion of the extruded frame (12). An inner transparent panel (18) is placed within a front portion of the extruded frame (12), so that the perimeter (18) will butt against an inner portion of the extruded frame (12). A front transparent panel (20) is also provided. An element (22) is for mounting the perimeter of the front transparent panel (20) in a removable manner to the inner transparent panel (18), so that a sign (24) can fit between the inner transparent panel (18) and the front transparent panel (20). A facility (26) within the extruded frame (12) between the rear panel (14) and the inner transparent panel (18) is for producing light, so as to illuminate the sign (24) therein.

14 Claims, 3 Drawing Sheets

DISPLAY SIGN

BACKGROUND OF THE INVENTION

1. Field of the Invention

The instant invention relates generally to signs and more specifically it relates to an improved display sign.

2. Description of the Prior Art

Numerous signs have been provided in prior art that are adapted to exhibit various types of advertisements for the purpose of selling products or give out information to the public. While these units may be suitable for the particular purpose to which they address, they would not be as suitable for the purposes of the present invention as heretofore described.

SUMMARY OF THE INVENTION

A primary object of the present invention is to provide an improved display sign that will overcome the shortcomings of the prior art devices.

Another object is to provide an improved display sign which contains a special aluminum extruded frame having a narrow profile to retain neon and/or fluorescent lighting tubes therein, and hold multiple, interchangeable paper posters or multiple acrylic sign faces behind its transparent removable front panel.

An additional object is to provide an improved display sign that is portable due to its lightweight and can be free standing, hanging or wall mounted, since it has a narrow profile and a built-in interlocking frame system.

A further additional object is to provide an improved display sign that has the ability to interchange neon tubes via VELCRO, i.e., hook and loop type fastening material, so as to increase portability of the neon tubes, while reducing breakage and cost thereof.

A further object is to provide an improved display sign that is simple and easy to use, with the ability to take apart the extruded frame and re-sized to smaller dimensions.

A still further object is to provide an improved display sign that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
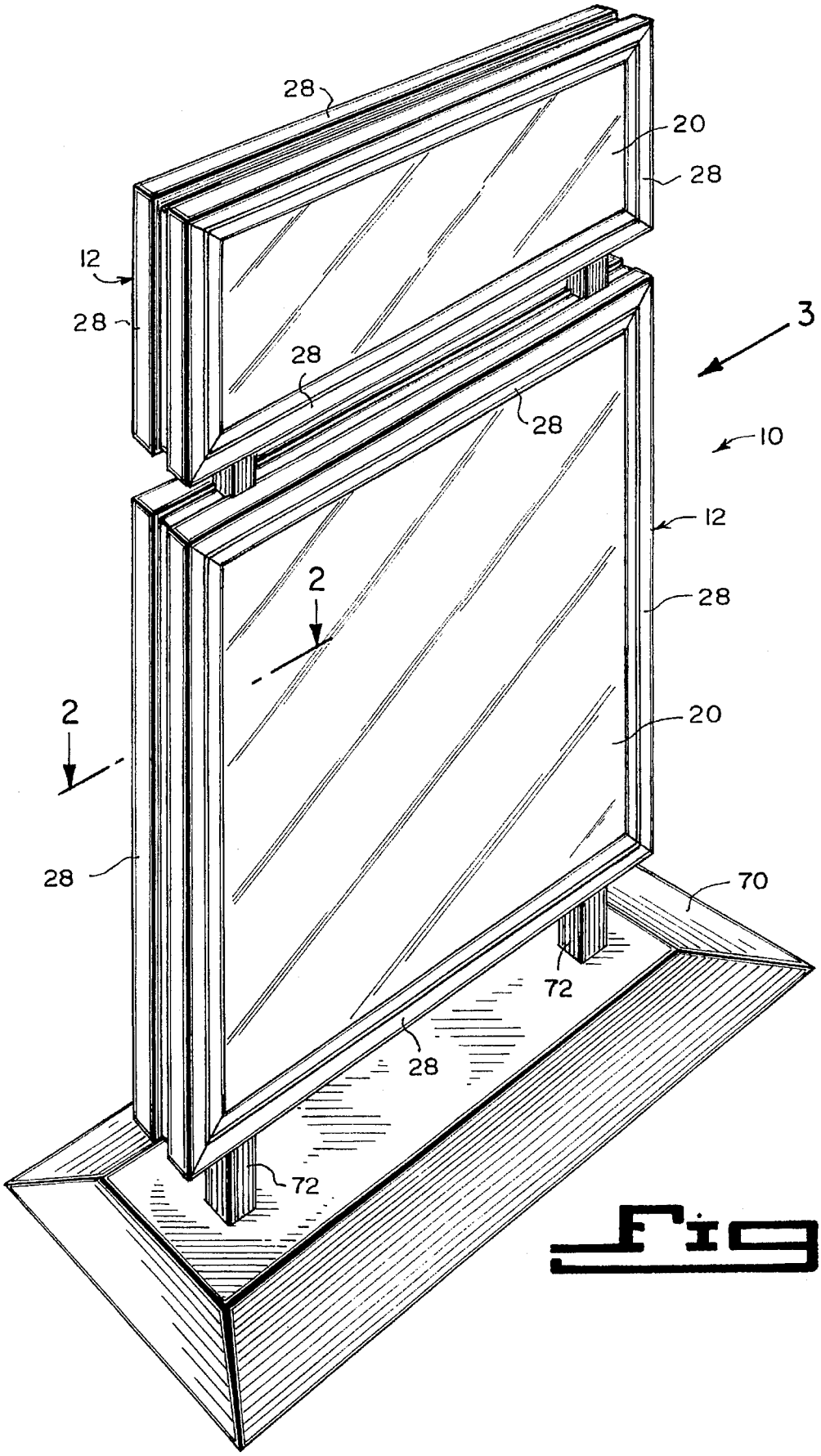
FIG. 1 is a perspective view of the instant invention.
Figure 2:
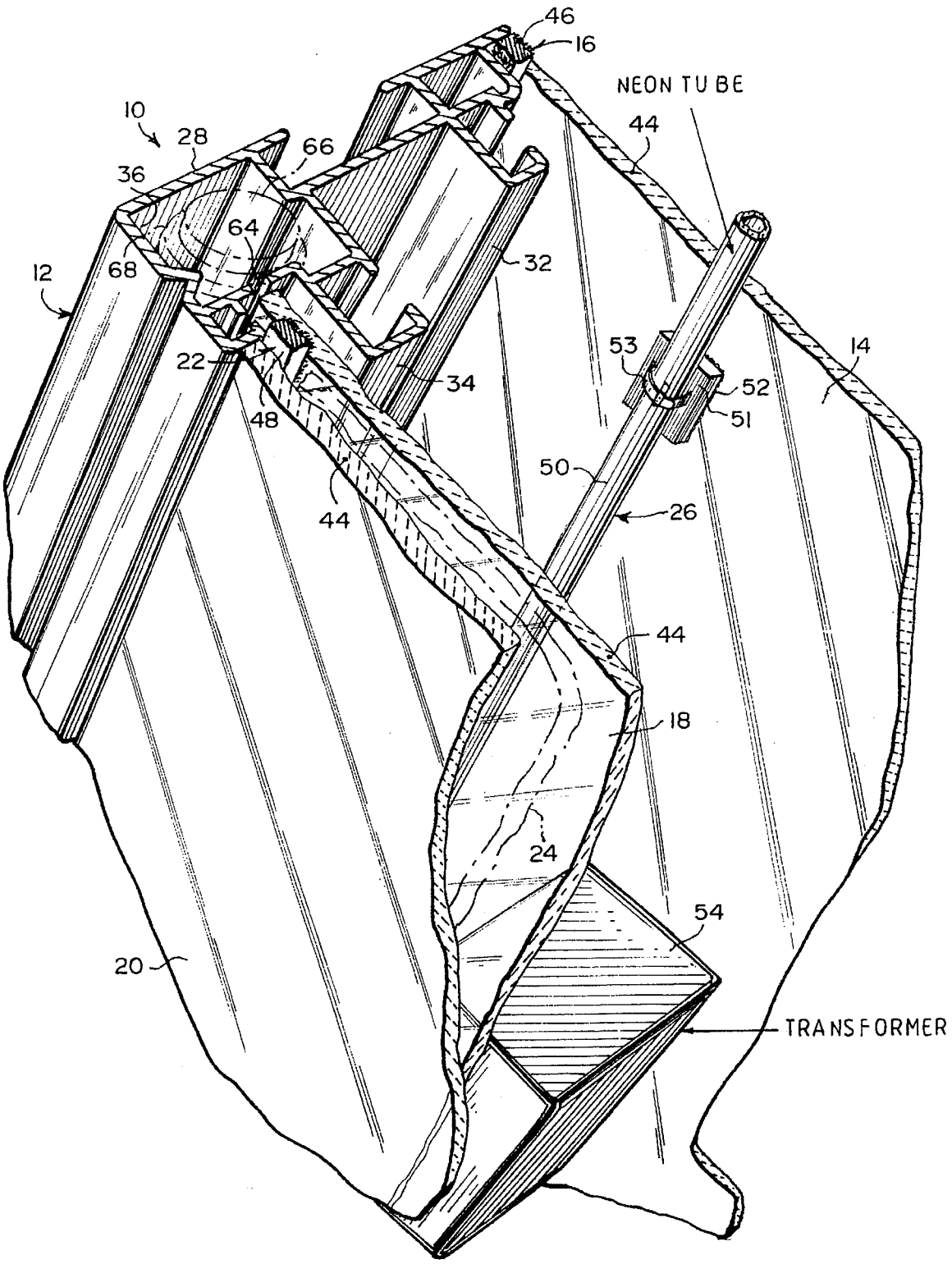
FIG. 2 is an enlarged cross sectional perspective view taken along line 2—2 in FIG. 1.
Figure 3:
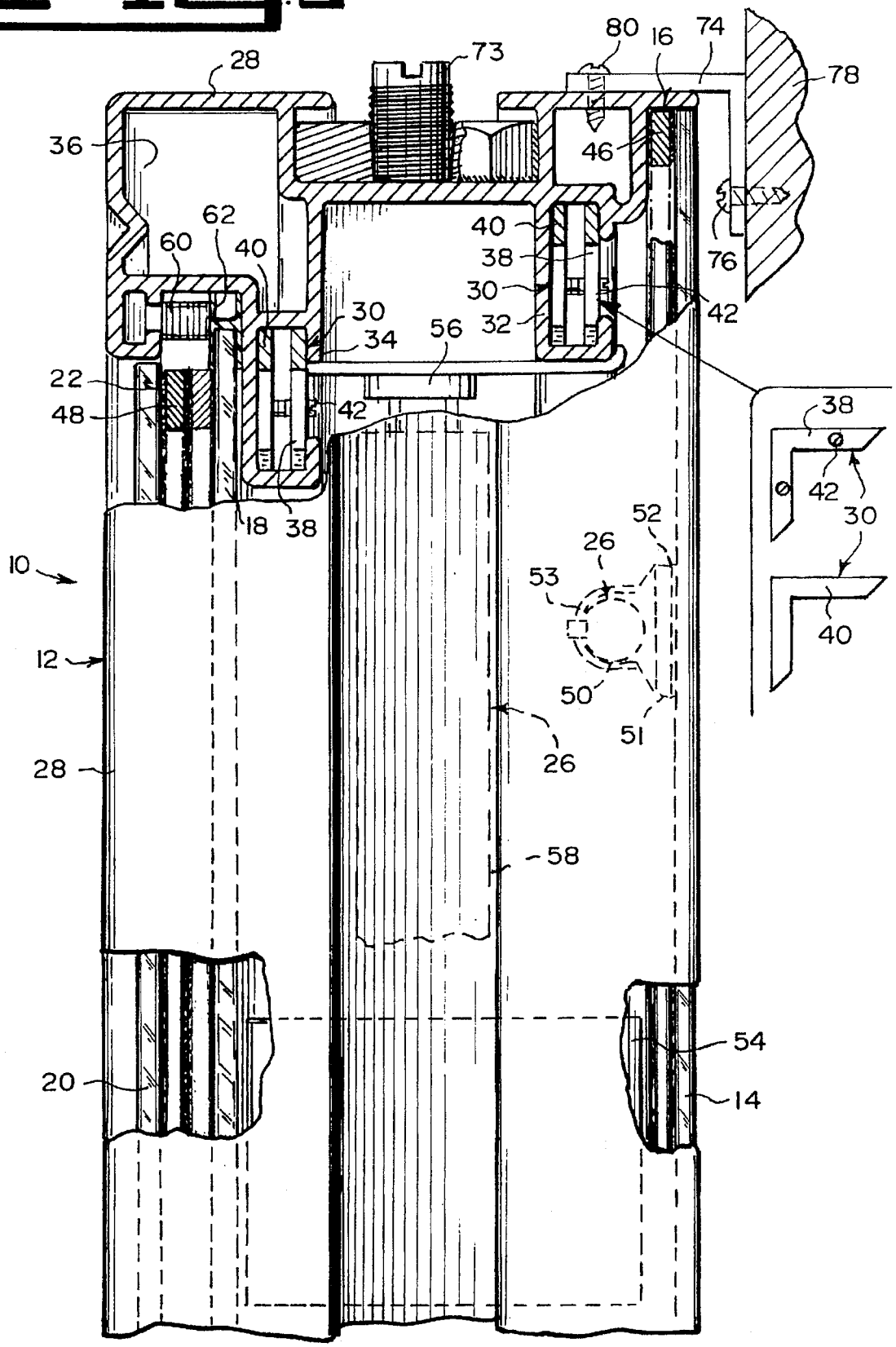
FIG. 3 is an enlarged side view taken in the direction of arrow 3 in FIG. 1, with parts broken away and in section, while some parts are shown in dotted hidden lines.

Turning now descriptively to the drawings, in which similar reference characters denote similar elements throughout the several views, FIGS. 1 through 3 illustrate an improved display sign 10, comprising an extruded frame 12. A rear panel 14 is provided. An element 16 is for mounting the perimeter of the rear panel 14 in a removable manner to a back portion of the extruded frame 12. An inner transparent panel 18 is placed within a front portion of the extruded frame 12, so that the perimeter of the inner transparent panel 18 will butt against an inner portion of the extruded frame 12. A front transparent panel 20 is also provided.

An element 22 is for mounting the perimeter of the front transparent panel 20 in a removable manner to the inner transparent panel 18, so that a sign 24 can fit between the inner transparent panel 18 and the front transparent panel 20. A facility 26 within the extruded frame 12 between the rear panel 14 and the inner transparent panel 18 is for producing light, so as to illuminate the sign 24 therein.

The extruded frame 12 consists of four segments 28 fitted together to extend about the perimeters of the rear panel 14, the inner transparent panel 18 and the front transparent panel 20. An assemblage 30, as shown in FIG. 3, is for joining the four segments 28 of the extruded frame 12 together. Each segment 28 of the extruded frame 12 includes a built-in rear channel 32, a built-in inner channel 34 and a front corner passageway 36.

The joining assemblage 30 consists of a plurality of corner brackets 38 and a plurality of matching back plates 40. Two setscrews 42 are for each corner bracket 38. One corner bracket 38 and one back plate 40 can be inserted into the built-in rear channel 32 and the built-in inner channel 34, between two segments 28 of the extruded frame 12. The setscrews 42 are tightened to hold the segments 28 together.

The rear panel 14, the inner transparent panel 18 and the front transparent panel 20 are fabricated out of acrylic material 44. The first mounting element 16 is a strip of VELCRO material 46. The second mounting element 22 is a strip of VELCRO material 48. The first mounting element 16 can also be screws, double sided tape or a weld.

The light producing facility 26 consists of a neon tube 50. A plurality of quick mount mounting pads 51 with adhesive backings 52 and ties 53 are for attaching the neon tube 50 to an inner surface of the rear panel 14. A self contained transformer 54 is carried between the rear panel 14 and the inner transparent panel 18. The transformer and ballast 54 will electrically power the neon tube 50.

The light producing facility 26, shown in FIG. 3, can also include a fluorescent lighting fixture 56 with ballast affixed into the extruded frame 12, between the rear panel 14 and the inner transparent panel 18. A fluorescent bulb 58 is carried in the fluorescent lighting fixture 56 and will be electrically powered by the ballast therein.

As shown in FIG. 2, a plurality of picture frame type springs 60 can be supplied. They are compressed and inserted between the inner transparent panel 18 and a front portion of the extruded frame 12, so as to force the inner transparent panel 18 to better butt against the inner portion of the extruded frame 12 depending upon thickness thereof. An extruded H channel member 62 can be inserted about the perimeter edges of the inner transparent panel 18, to allow electrical wiring access therethrough.

As shown in FIG. 2, an inner portion of the extruded frame 12 can have an elongated slot 64 at the front corner passageway 36. A neon tube 66 is provided. A plurality of O-rings 68 are placed onto the neon tube 66. The neon tube 66 can be inserted into the front corner passageway 36, to light up the edges of the inner transparent panel 18.

The improved display sign 10 shown in FIG. 1, contains a flat base 70 to sit upon a floor. A pair of legs 72 spaced apart and are attached by screwing each leg 72 to an interlocking screw 73, as shown in FIG. 3, on the bottom of the extruded frame 12 and are also attached to the flat base 70, so as to support the improved display sign 10 in an upright position from the floor. In FIG. 3, an angle iron bracket 74 is mounted by a first fastener 76, to a vertical wall 78. The angle iron bracket 74 is mounted by a second fastener 80 to a top surface of the extruded frame 12, so as to support the improved display sign 10 in an upright position on the vertical wall 80.

LIST OF REFERENCE NUMBERS

10 improved display sign
12 extruded frame of 10
14 rear panel of 10
16 first mounting element of 10
18 inner transparent panel of 10
20 front transparent panel of 10
22 second mounting element of 10
24 sign between 18 and 20
26 light producing facility of 10
28 segment of 12
30 joining assemblage for 28
32 built-in rear channel in 28
34 built-in inner channel in 28
36 front corner passageway in 28
38 corner bracket of 30
40 matching back plate of 30
42 setscrew in 38
44 acrylic material of 14, 18 and 20
46 strip of VELCRO material for 16
48 strip of VELCRO material for 22
50 neon tube for 26
51 quick mount mounting pad on 50
52 adhesive backing on 51
53 tie on 51
54 transformer and ballast for 50
56 fluorescent lighting fixture with ballast for 26
58 fluorescent bulb in 56
60 picture frame type spring between 18 and 12
62 extruded H channel member for 18
64 elongated slot in 12 at 36
66 neon tube in 36
68 O-ring on 66
70 flat base
72 leg
73 interlocking screw on 12
74 angle iron bracket
76 first fastener in 74
78 vertical wall
80 second fastener in 74

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An improved display sign comprising:

a) an extruded frame;

b) a rear panel;

c) means for mounting the perimeter of said rear panel in a removable manner to a back portion of said extruded frame;

d) an inner transparent panel placed within a front portion of said extruded frame, so that the perimeter of said inner transparent panel will butt against an inner portion of said extruded frame;

e) a front transparent panel;

f) means for mounting the perimeter of said front transparent panel in a removable manner to said inner transparent panel, so that a sign can fit between said inner transparent panel and said front transparent panel; and g) means within said extruded frame between said rear panel and said inner transparent panel for producing light, so as to illuminate the sign therein, wherein said light producing means includes:

i) a neon tube;

ii) a plurality of quick mount mounting pads with adhesive backings and ties for attaching said neon tube to an inner surface of said rear panel; and iii) a self contained transformer and ballast carried between said rear panel and said inner transparent panel, whereby said transformer and ballast will electrically power said neon tube.

2. An improved display sign, comprising:

a) an extruded frame;

b) a rear panel;

c) means for mounting the perimeter of said rear panel in a removable manner to a back portion of said extruded frame;

d) an inner transparent panel placed within a front portion of said extruded frame, so that the perimeter of said inner transparent panel will butt against an inner portion of said extruded frame;

e) a front transparent panel;

f) means for mounting the perimeter of said front transparent panel in a removable manner to said inner transparent panel, so that a sign can fit between said inner transparent panel and said front transparent panel; and g) means within said extruded frame between said rear panel and said inner transparent panel for producing light, so as to illuminate the sign therein, h) a plurality of picture frame type springs that are compressed and inserted between said inner transparent panel and a front portion of said extruded frame, so as to force said inner transparent panel to better butt against the inner portion of said extruded frame depending upon thickness thereof; and i) an extruded H channel member inserted about the perimeter edges of said inner transparent panel to allow electrical wiring access therethrough.

3. An improved display sign, comprising:

a) an extruded frame b) a rear panel;

c) means for mounting the perimeter of said rear panel in a removable manner to a back portion of said extruded frame;

d) an inner transparent panel placed within a front portion of said extruded frame, so that the perimeter of said inner transparent panel will butt against an inner portion of said extruded frame;

e) front transparent panel;

f) means for mounting the perimeter of said front transparent panel in a removable manner to said inner transparent panel, so that a sign can fit between said inner transparent panel and said front transparent panel;

g) means within said extruded frame between said rear panel and said inner transparent panel for producing light, so as to illuminate the sign therein;

wherein said extruded frame consists of four segments fitted together to extend about the perimeters of said rear panel, said inner transparent panel and said front transparent panel; and means for joining said four segments of said extruded frame together; wherein each segment of said extruded frame includes:

i) a built-in rear channel;

ii) a built-in inner channel; and iii) a front corner passageway.

4. An improved display sign as recited in claim 3, further including:

a) an inner portion of said extruded frame having an elongated slot at said front corner passageway;

b) a neon tube; and c) a plurality of O-rings placed onto said neon tube, so that said neon tube can be inserted into said front corner passageway, to light up the edges of said inner transparent panel.

5. An improved display sign as recited in claim 3, wherein said joining means includes:

a) a plurality of corner brackets;

b) a plurality of matching back plates; and c) two setscrews for each said corner bracket, so that one said corner bracket and one said back plate can be inserted into said built-in rear channel and said built-in inner channel between two said segments of said extruded frame and said setscrews tightened to hold said segments together.

6. An improved display sign as recited in claim 5, wherein said rear panel, said inner transparent panel and said front transparent panel are fabricated out of acrylic material.

7. An improved display sign as recited in claim 6, wherein said means for mounting the perimeter of said rear panel to said extruded frame is a strip of hook and loop fastening material.

8. An improved display sign as recited in claim 7, wherein said means for mounting the perimeter of said front transparent panel to said inner transparent panel is a strip of hook and loop fastening material.

9. An improved display sign as recited in claim 8, wherein said light producing means includes:

a) a neon tube;

b) a plurality of quick mount mounting pads with adhesive backings and ties, for attaching said neon tube to an inner surface of said rear panel; and c) a self contained transformer and ballast carried between said rear transparent panel and said inner panel, whereby said transformer and ballast will electrically power said neon tube.

10. An improved display sign as recited in claim 9, wherein said light producing means includes:

a) a fluorescent lighting fixture with ballast affixed into said extruded frame between said rear panel and said inner transparent panel; and b) a fluorescent bulb carried in said fluorescent lighting fixture and will be electrically powered by said ballast therein.

11. An improved display sign as recited in claim 10, further including:

a) a plurality of picture frame type springs that are compressed and inserted between said inner transparent panel and a front portion of said extruded frame, so as to force said inner transparent panel to better butt against the inner portion of said extruded frame depending upon thickness thereof; and b) an extruded H channel member inserted about the perimeter edges of said inner transparent panel to allow electrical wiring access therethrough.

12. An improved display sign as recited in claim 11, further including:

a) an inner portion of said extruded frame having an elongated slot at said front corner passageway;

b) a second neon tube; and c) a plurality of O-rings placed onto said second neon tube, so that said second neon tube can be inserted into said front corner passageway, to light up the edges of said inner transparent panel.

13. An improved display sign as recited in claim 12, further including:

a) a flat base to sit upon a floor; and b) a pair of legs spaced apart are attached by screwing each said leg to an interlocking screw on the bottom of said extruded frame and are also attached to said flat base, so as to support said improved display sign in an upright position from the floor.

14. An improved display sign as recited in claim 12, further including an angle iron bracket mounted by a first fastener to a vertical wall and mounted by a second fastener to a top surface of said extruded frame, so as to support said improved display sign in an upright position on the vertical wall.

* * * * *